US010340097B2

(12) United States Patent
Weber et al.

(10) Patent No.: US 10,340,097 B2
(45) Date of Patent: Jul. 2, 2019

(54) INSTALLATION SWITCHING DEVICE HAVING A CONTACT CLAMP

(71) Applicant: ABB Schweiz AG, Baden (CH)

(72) Inventors: Ralf Weber, Heidelberg (DE); Erwin Muders, Heidelberg (DE); Klaus-Peter Eppe, Waldbrunn (DE); Alexander Orban, Weinheim (DE)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/806,353

(22) Filed: Nov. 8, 2017

(65) Prior Publication Data

US 2018/0151310 A1 May 31, 2018

(30) Foreign Application Priority Data

Nov. 28, 2016 (DE) ..... 10 2016 122 852

(51) Int. Cl.
*H01R 43/20* (2006.01)
*H01H 9/02* (2006.01)
*H01R 4/36* (2006.01)

(52) U.S. Cl.
CPC ..... *H01H 9/02* (2013.01); *H01R 4/36* (2013.01); *H01R 43/20* (2013.01)

(58) Field of Classification Search
CPC ..... H01R 4/363; H01R 4/304; H01R 43/16; H01R 4/301; H01R 9/26; H01R 9/2633; H01R 43/00; H01R 4/2425; H01R 4/2475; H01R 4/307; H01R 4/36; H01R 4/366; H01R 4/42; H01R 9/24
USPC .... 439/810, 811, 812, 733.1, 782, 793, 813; 200/507
See application file for complete search history.

(56) References Cited

U.S. PATENT DOCUMENTS 3,562,701 A * 2/1971 Orr ..... H01R 4/363 403/236
3,864,005 A * 2/1975 Klein ..... H01R 4/363 24/115 N
4,611,876 A * 9/1986 Barrabes ..... H01R 4/301 439/733.1

(Continued)

FOREIGN PATENT DOCUMENTS

DE 19805909 A1 8/1999
DE 102007060077 A1 10/2008

*Primary Examiner* — Ahmed M Saeed
(74) *Attorney, Agent, or Firm* — Leydig, Voit & Mayer, Ltd.

(57) ABSTRACT

An installation switching device includes: a housing; and at least one contact clamp, which is arranged in the housing, for connecting at least one electrical conductor through a conductor insertion opening that is provided in the housing, the contact clamp including a clamping frame that has a rectangular cross section and a clamping screw that engages in a first narrow end side of the clamping frame and a clamping end of the clamping screw being cooperating with a section of a contact rail that is fixedly mounted in the housing of the installation switching device, the section being located within the clamping frame, so that a second narrow end side that lies opposite the first narrow end side and is connected thereto via two longitudinal sides that lie opposite one another presses an inserted connecting conductor against a surface of the contact rail that is remote from the clamping screw.

10 Claims, 8 Drawing Sheets

(56) References Cited

U.S. PATENT DOCUMENTS

| | | | | |
|---|---|---|---|---|
| 7,438,606 | B2 * | 10/2008 | Pizzi | H01R 4/42 439/793 |
| 7,798,869 | B1 * | 9/2010 | Konopacki | H01R 4/363 439/812 |
| 2008/0268722 | A1 | 10/2008 | Wieland et al. | |
| 2013/0252486 | A1 * | 9/2013 | Kosyanchuk | H01R 4/304 439/813 |
| 2014/0248808 | A1 * | 9/2014 | Niehoerster | H01R 4/36 439/810 |

* cited by examiner

INSTALLATION SWITCHING DEVICE HAVING A CONTACT CLAMP

CROSS-REFERENCE TO PRIOR APPLICATION

Priority is claimed to German Patent Application No. DE 10 2016 122 852.4, filed on Nov. 28, 2016, the entire disclosure of which is hereby incorporated by reference herein.

FIELD

The invention is based on an installation switching device having a housing and at least one contact clamp, which is arranged in the housing, for connecting at least one electrical conductor through a conductor insertion opening that is provided in the housing, said contact clamp comprises a clamping frame that has a rectangular cross section and a clamping screw engages in the first narrow end side of the clamping frame and the clamping end of said clamping screw cooperates with a contact rail that is fixedly mounted in the housing of the installation switching device, so that the second narrow end side that lies opposite the first narrow end side and is connected thereto via two longitudinal sides that lie opposite one another presses an inserted connecting conductor against the surface of the contact rail that is remote from the clamping screw, wherein a clamp covering part is coupled to the clamping frame.

BACKGROUND

Screw clamps are widely used in particular in household installation technology and are used for the purpose of connecting electrical connecting conductors to an installation device, by way of example a circuit breaker or a fault-current circuit breaker.

Such installation switching devices comprise a housing that is embodied from an insulating material and comprises at least one front wall, a fastening wall that lies opposite said front wall and it is possible to provide on said fastening wall fastening devices for snapping on or fastening in any other form the installation switching device to a mounting rail or to another fastening device, said housing that is embodied from an insulating material also comprises narrow and broad sides that are connected to the front wall and the fastening wall.

The screw clamps for connecting the connecting conductor are typically attached in the region of the narrow sides in the installation switching device. The further construction elements or assemblies that are required for the intended function of the installation switching device are located in the interior of the installation switching device, said construction elements or assembles being by way of example triggers, switching levers and contact pieces, an arc quenching device, adjusting devices etc.

Known screw clamps comprise a clamping frame that has a rectangular cross section and a clamping screw that protrudes into the clamping frame through a threaded hole in a first transverse arm of the clamping frame. The clamping frame is moved along the axis of the clamping screw by means of rotating the clamping screw. A clamping space for fixedly clamping a connecting conductor is formed in the interior of the clamping frame.

A connecting conductor that is inserted into the clamping frame is consequently fixedly clamped in the clamping space.

A contact clamp that is referred to as a so-called rising clamp, a screw clamp having a clamping frame that is approximately rectangular in shape, is disclosed in DE 198 05 909 A1. In the case of the contact clamp disclosed in DE 198 05 909 A1, when a connecting conductor is being clamped under the influence of the clamping screw, the rectangular clamping frame is displaced relative to a contact rail that is inserted into the interior of the clamping frame, as a result of which the connecting conductor is fixedly clamped in the space between the clamping frame and the face of the contact rail that is remote from the clamping screw.

DE 10 2007 060 077 A1 discloses an installation switching device having a similarly constructed screw clamp that is also embodied in the manner of a rising clamp, wherein the part of the clamping frame that when in the assembled position can be touched through the insertion opening from outside the device housing is covered by an insulating material in the form of an insulating part that is plate-shaped and is latched in the forwards direction to the clamping frame in the region of the lower transverse arm of the clamping frame. It is necessary to attach the insulating part to the clamping frame prior to assembling the connecting clamp in the device housing, and in the region in which the insulating part is attached said insulating part increases the dimensions of the clamping frame forwards in the direction of the insertion opening, said insulating part increases as the space required for the connecting clamp. When a clamp is not completely opened, a free space occurs between the lower transverse piece of the clamping frame and the lower edge of the conductor insertion opening and it is possible for a connecting conductor to be incorrectly inserted into said free space so that the connecting conductor would not be inserted into the interior of the connecting clamp but rather would be inserted adjacent to said clamp, and this is also referred to as an incorrect insertion procedure. An incorrect insertion procedure must be avoided during the installation procedure.

SUMMARY

In an embodiment, the present invention provides an installation switching device comprising: a housing; and at least one contact clamp, which is arranged in the housing, configured to connect at least one electrical conductor through a conductor insertion opening that is provided in the housing, the contact clamp comprising a clamping frame that has a rectangular cross section and a clamping screw that is configured to engage in a first narrow end side of the clamping frame and a clamping end of the clamping screw being configured to cooperate with a section of a contact rail that is fixedly mounted in the housing of the installation switching device, the section being located within the clamping frame, so that a second narrow end side that lies opposite the first narrow end side and is connected thereto via two longitudinal sides that lie opposite one another is configured to press an inserted connecting conductor against a surface of the contact rail that is remote from the clamping screw, wherein a clamp covering part is coupled to the clamping frame, wherein the clamp covering part has a tub-shaped cross section having two short arms that lie opposite one another and a connecting piece that connects the two short arms to one another, wherein a first short arm is coupled to the first narrow end side and a second short arm that lies opposite the first short arm is coupled to the second narrow side, and wherein the second short arm supports a skirt that protrudes over the second narrow end side in a direction facing away from the clamping screw.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
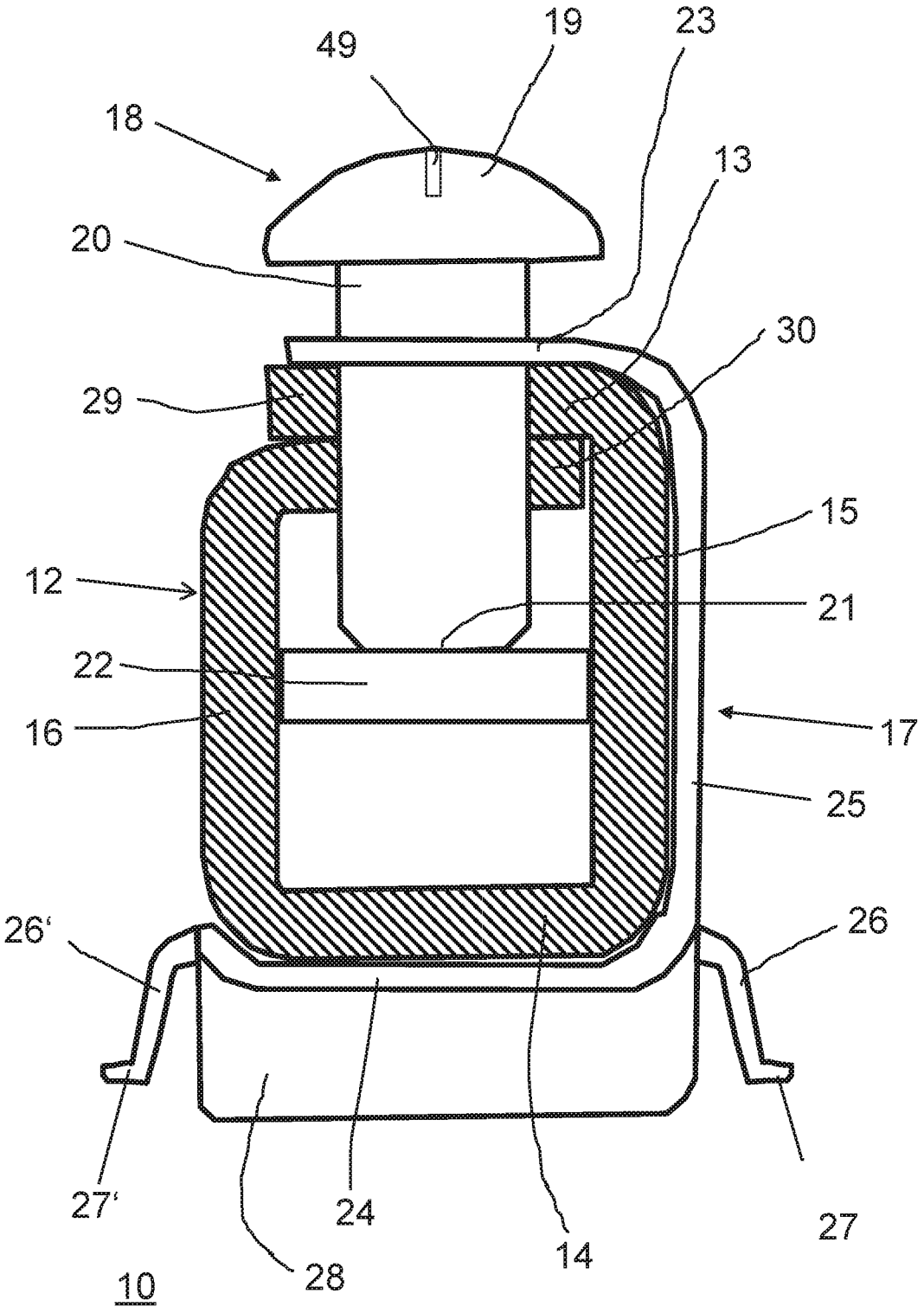
FIG. 1 illustrates schematically a cross section through a connecting clamp in accordance with the invention showing how said clamp is used in an installation switching device in accordance with the invention.

In accordance with the invention, the clamp covering part has a tub-shaped cross section comprising two short arms that lie opposite one another, and a connecting piece that connects the two short arms to one another, wherein a first short arm is coupled to the first narrow end side and the second short arm that lies opposite the first short arm is coupled to the second narrow side, wherein the second short arm supports a skirt that protrudes over the second narrow end side in the direction facing away from the clamping screw.

The skirt of the clamp covering part provides a contact protection and a protection against incorrect insertion procedures. Since, if the clamp is partly closed, the clamping frame is displaced slightly upwards in the direction of its closed position, the skirt that protrudes over the second narrow end side in the direction facing away from the clamping screw covers the free space that occurs between the lower transverse piece of the clamping frame and the lower edge of the conductor insertion opening so that it is not possible to insert the connecting conductor incorrectly. The skirt also prevents possibly live parts from being contacted on the underside of the clamping frame from the outside through the connecting opening. Owing to the tub-shaped cross section having two end-side short arms and a connecting piece that connects the two short arms, it is possible to also slide the clamp covering part having the skirt onto the clamping frame after said clamping frame has been assembled in one of the housing half shells. For this purpose, the clamp covering part is slid with the open longitudinal side first onto the clamping frame, wherein the first short arm of the clamp covering part is coupled to the first narrow end side of the clamping frame, and the second short arm of the clamp covering part, said second short arm lying opposite the first short arm, is coupled to the second narrow side of the clamping frame.

In one advantageous embodiment, the tub-shaped cross-sectional contour of the clamp covering part is adjusted to the frame-type outer contour of the clamping frame so that the clamp covering part can be slid on in a sliding-on direction perpendicular to the broad side of the housing half shell after assembling the clamping frame in a first housing half shell of the housing.

In accordance with one advantageous embodiment, the clamp covering part supports two latching arms that lie opposite one another and that protrude out from the skirt laterally and in a resilient manner in the region of the skirt and can be latched in a releasable manner to the inner face of the housing when the contact clamp is in the assembled position. For this purpose, in one advantageous embodiment, first latching elements are formed on the latching arms and second latching elements are formed on the inner face of the housing so as to cooperate in a latching manner when the connecting clamp is in the opened position. As a consequence, the opened clamp is kept open and the opened clamping frame is prevented from unintentionally sliding in the direction of its closed position.

In accordance with one advantageous embodiment, the clamping frame is bent from strip material, wherein the first end side is formed from overlapping strip ends into which the clamping screw engages. For this purpose, a threaded opening is provided in the overlapping region of the two strip ends, said threaded opening having an inner thread that corresponds to the outer thread of the clamping screw and it is possible to screw the clamping screw with its clamping end ahead into said threaded opening. The embodiment where a clamping frame is bent from strip material renders it possible to produce a stamped bent part in a cost-effective manner.

In accordance with one advantageous embodiment, the first short arm of the clamp covering part is embodied with a latching opening so that the first short arm can be latched to the latching opening on the clamping screw. The clamp covering part is thus respectively entrained by the clamping frame that slides when the connecting clamp is being opened or closed in the longitudinally extending direction of said clamping frame relative to the housing and relative to the contact rail, wherein said clamping frame is latched on the clamping screw and the clamping screw can rotate further unhindered in the latching opening. In one advantageous embodiment, the latching opening is open on the narrow side of the first short arm that is remote from the connecting piece so that at that location two free arms are formed, as a result of which it is rendered possible to slide the first short arm onto the first end side encompassing the clamping screw between the two free arms when the clamping frame has already been assembled in the housing. The clamping screw is held in a latching manner between the two free arms as the clamp covering part is being slid on.

In one advantageous embodiment, the housing supports in the region of the insertion opening at least one protruding portion that protrudes outwards from the housing wall. The protruding portion is attached in a raised manner on the outer face of the housing. The protruding portion acts as a further contact protection. The protruding portion is raised to such an extent that a finger can no longer reach potentially live parts of the connecting clamp that are possibly not covered by the clamp covering part or by other housing parts and indeed said finger is prevented from doing so by the protruding portion that protrudes outwards.

In particular, the protruding portion is embodied in such a manner that a testing finger that is a synthetic finger that recreates in its dimensions an average human finger and that is used during standardised tests in lieu of an actual human finger for testing the contact protection on electric devices can no longer reach potentially live parts of the connecting clamp. In one advantageous embodiment, the protruding portion surrounds the insertion opening in a U-shaped manner.

In order to render it possible for an actuating tool, by way of example a screwdriver, to access the clamping screw, an access opening is provided at a suitable site in the housing wall of the installation switching device. The free diameter of said access opening is dimensioned in one advantageous embodiment in such a manner that it is not possible for a human finger or a testing finger to make touching contact through the access opening with the potentially live clamping screw. This invention also increases the advantageous developing measure and ensures a reliable contact protection of the installation switching device in accordance with the invention.

In the figures, identical or identically-functioning components, elements or assemblies are provided with the same reference numerals.

Figure 3:
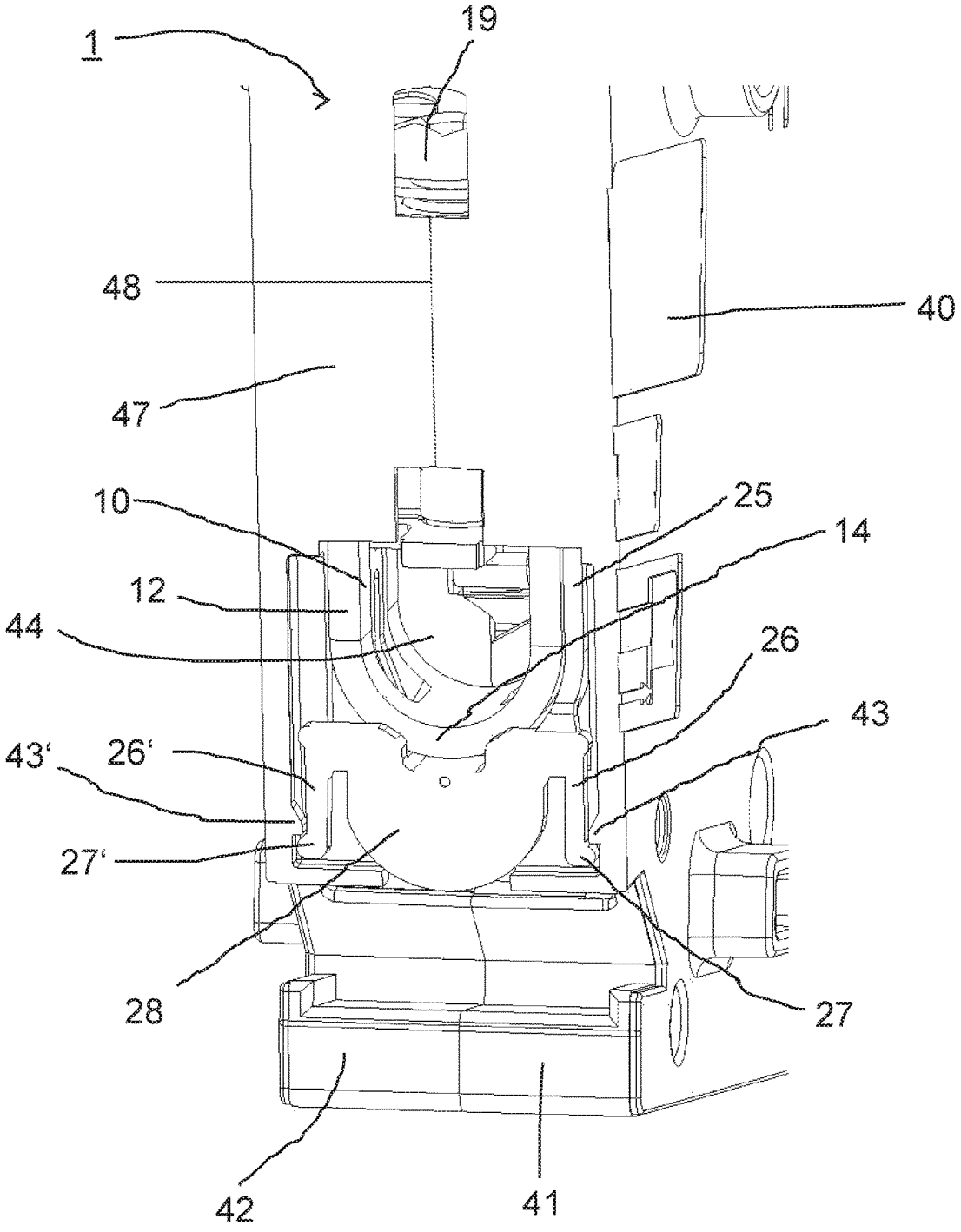
FIG. 3 illustrates a plan view of the partially opened narrow side of an installation switching device in accordance with one embodiment of the invention.
Figure 5:
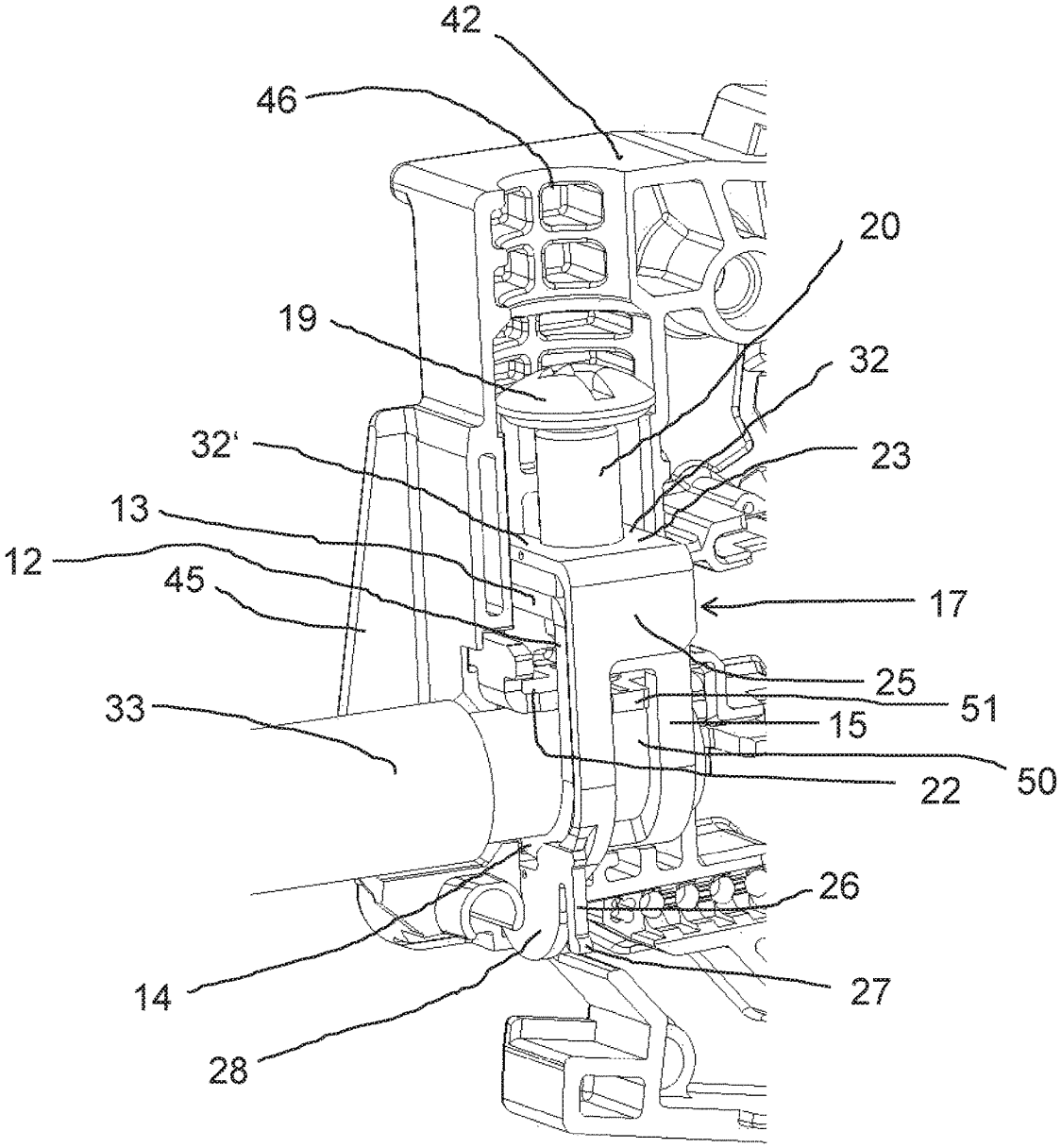
FIG. 5 illustrates a view into the region of the clamp receiving space of a partially opened installation switching device in accordance with an embodiment of the invention in which the upper housing half shell has been removed and a connecting conductor has been inserted.

FIG. 3 illustrates a plan view of the partially opened narrow side 47 of an installation switching device 1, in this case a circuit breaker, however, it could also be a fault-current circuit breaker, a motor protection circuit breaker or the like. The installation switching device 1 comprises a housing 40 that is embodied from insulating material, by way of example a thermoplastic. In the example, the housing 40 is embodied as a shell housing, assembled from two half shells 41, 42 that are joined together along a circumferential joining line 48 and receive between said half shells all the assemblies and parts that are required for the function of the installation switching device. A contact clamp 10 is arranged in the housing 40 in a clamp receiving space near to the narrow side 47 of the housing 40 so as to connect at least one electrical conductor 33, the conductor 33 is illustrated in FIG. 5. The connecting conductor 33 is inserted through a conductor insertion opening 44 that is provided in the housing 40.

A cross section through the contact clamp 10 is illustrated schematically in FIG. 1. The contact clamp 10 comprises a clamping frame 12 that is bent from a section of strip material to form an essentially rectangular contour, said clamping frame having two longitudinal sides 15, 16 that lie opposite one another and two narrow end sides 13, 14 that are provided lying opposite to one another and essentially at a right angle to said longitudinal sides, and also a clamping screw 18 having a screw shaft 20 that supports a screw thread, and a screw head 19 that comprises an engagement element for being engaged by an actuating tool, by way of example a screwdriver, said engagement element being illustrated as a slot 49. The first narrow end side 13 is formed from the overlapping ends 29, 30 of the strip section. A hole that is arranged approximately centrally and comprises an inner thread is formed in said overlapping region and the clamping screw 18 engages in said hole. The second narrow end side 14 can also comprise a contour that is embodied with a radius, wherein the radius is dimensioned in such a manner that it corresponds to the outer diameter of the largest connecting conductor end piece that can be inserted, as is illustrated in FIG. 5.

A section of a contact rail 22 that is fixedly mounted in the housing 40 forms a part of the current path that extends starting from the connecting clamp 10 into or through the installation switching device, by way of at least one contact site that can be connected, to a further connecting clamp on the opposite-lying narrow side of the housing 40. The section of the contact rail 22 with which the clamping end of the connecting conductor is clamped is located at least in part within the clamping frame 12. The clamping end 21 of the clamping screw 18 cooperates with the contact rail 22 so that the second narrow end side 14 that lies opposite the first narrow end side 13 and is connected thereto via the two longitudinal sides 15, 16 that lie opposite one another presses an inserted connecting conductor 33 against the surface of the contact rail 22 that is remote from the clamping screw 18.

A clamp covering part 17 that is likewise embodied from an insulating material is coupled to the clamping frame 12. The clamp covering part 17 is illustrated schematically in FIG. 1 and illustrated in detail in FIG. 2 in a preferred embodiment. Said clamp covering part comprises a tub-shaped cross section having two short arms 23, 24 that lie opposite one another and a connecting piece 25 that connects the two short arms 23, 24 to one another. A first, short arm 23 is coupled to the first narrow end side 13, and the second short arm 24 that lies opposite the first short arm 23 is coupled to the second narrow side 14.

The second short arm 24 supports a skirt 28 in the form of a plate-shaped attachment that protrudes over the second narrow end side 14 in the direction facing away from the clamping screw 18. The tub-shaped cross section contour of the clamp covering part 17 is adjusted to the frame-shaped outer contour of the clamping frame 12. As a consequence, the advantage is provided that the clamp covering part 17 can be slid in a sliding-on direction perpendicular to the broad side of the housing half shell 42 after the clamping frame 12 has been assembled in a first housing half shell 42 of the housing 40. FIG. 5 illustrates a view into the region of the clamp receiving space of a partially opened installation switching device in which the upper housing half shell has been removed and a connecting conductor has been inserted. It is possible to see the lower housing half shell 42 having the inserted clamping frame 12. The clamp covering part 17 is illustrated in its position slid onto the clamping frame. It is possible to easily imagine that initially the clamping frame 12 has been inserted and the clamp covering part 17 has been slid with its open longitudinal side ahead in the direction into the image plane of FIG. 5 onto the clamping frame.

Figure 2:
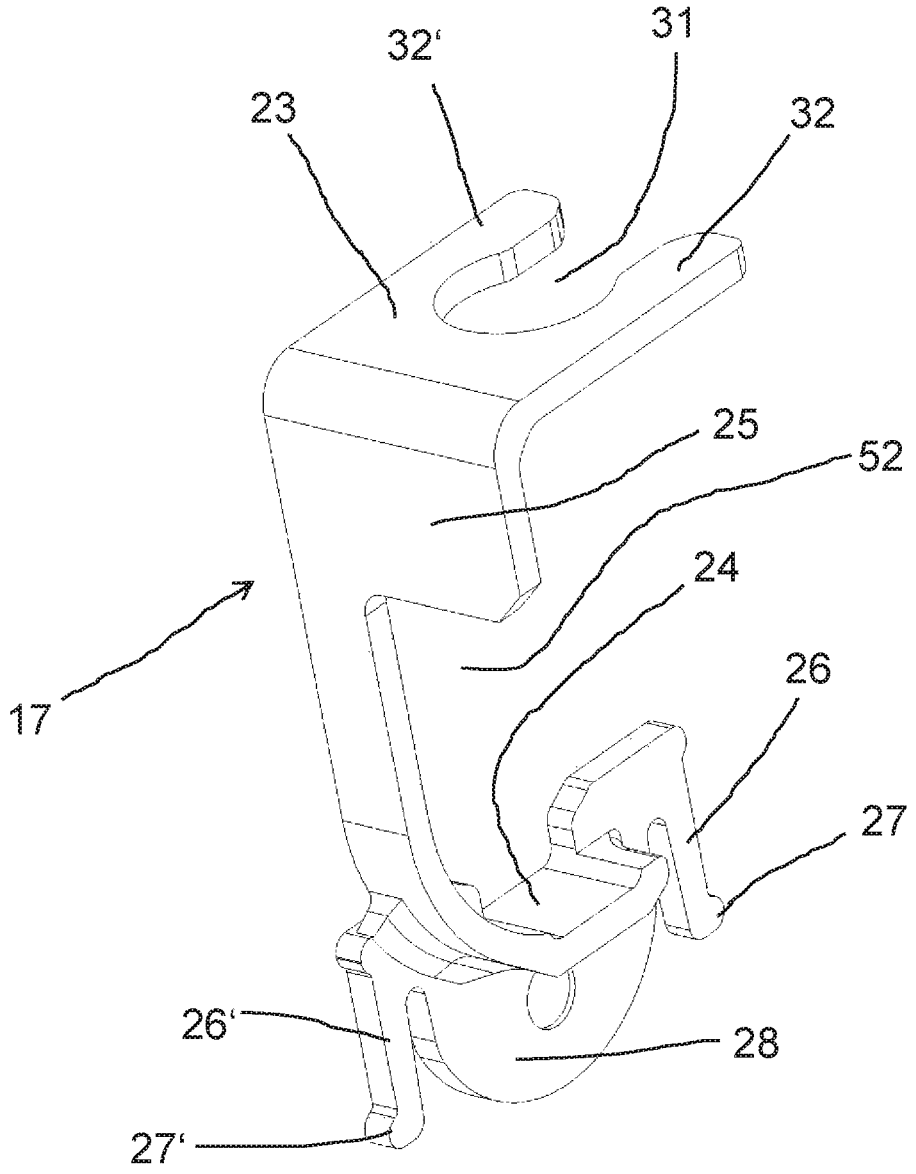
FIG. 2 illustrates a perspective view of an exemplary clamp covering part in accordance with one embodiment of the invention.

As is evident in particular in FIG. 2, the first short arm 23 is embodied with a latching opening 31 so that the first short arm 23 can be latched to the latching opening 31 first on the clamping screw 18, in this case on the screw shaft 20 of the clamping screw. The latching opening 31 is open on the narrow side of the first short arm 23 that is remote from the connecting piece 25 so that two free arms 32, 32' are formed at that location, as a result of which it is rendered possible to slide the first short arm 23 onto the first end side 13 whilst encompassing the clamping screw 18 between the two free arms 32, 32' when the clamping frame 12 has already been assembled in the housing.

Furthermore, as is evident in FIG. 5, the longitudinal sides 15, 16 of the clamping frame 12 are provided with a longitudinal slot 50 that is attached approximately centrally, in FIG. 5 only the one longitudinal side 15 is evident in this respect. A guiding projection 51 engages in this longitudinal slot 50, said guiding projection being located on a narrow longitudinal side of the contact frame 22. The guiding projection 51 in cooperation with the longitudinal slot 50 ensures that the clamping frame 12 is guided in its longitudinal sliding direction. So that the longitudinal slot 50 remains free, the connecting piece 25 of the clamp covering part 17 comprises a corresponding cut-out 52, which reveals the longitudinal slot 50, at the site at which said connecting piece would come to lie when it is being slid onto the clamping frame 12 by way of said longitudinal slot.

The connecting clamps have already been opened by the manufacturer prior to being delivered to the customer so that it is not necessary for the installer when using the installation device to spend assembly time screwing on the connecting clamp. In order to ensure during transportation to the customer that the opened clamp remains open and to prevent the clamping frame from sliding in the direction of its closed position as a result of shocks or vibrations when transporting the installation switching device, the clamp covering part 17 supports two latching arms 26, 26' that lie opposite one another and protrude out from the skirt laterally and in a resilient manner in the region of the skirt 28 and can be latched in a releasable manner to the inner face of the housing when the contact clamp 10 is in the assembled position. For this purpose, first latching elements 27, 27' in the form of latching lugs are formed on the latching arms 26, 26' and second latching elements 43, 43' in the form of latching projections are formed on the inner face of the housing 40 so as to cooperate in a latching manner when the connecting clamp is in the opened position.

As an additional contact protection, the housing 40 in the region of the insertion opening 44 supports at least one protruding portion 45 that protrudes outwards from the housing wall and surrounds the insertion opening 44 in a U-shaped manner.

An access opening 46 that renders it possible for an actuating tool 53, by way of example a screwdriver, to access the screw head 19 of the clamping screw 18 is provided in the housing 40. Said access opening is dimensioned in its free diameter in such a manner that it is not possible for a human finger or a testing finger 53 to make touching contact with the clamping screw 18 through the access opening 46, cf. FIG. 8.

Figure 4:
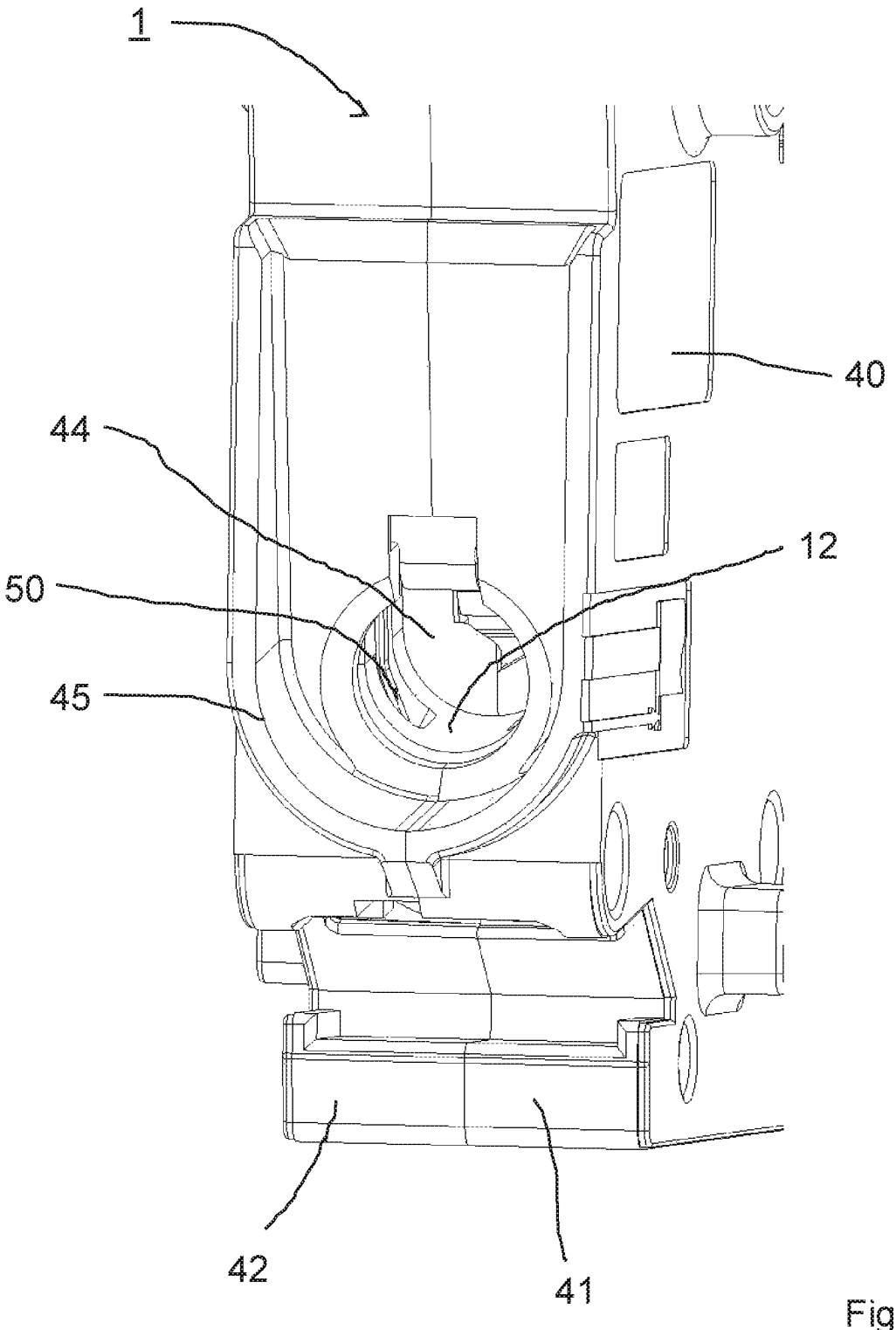
FIG. 4 illustrates a view of the narrow side of an installation switching device in accordance with one embodiment of the invention when the connecting clamp is in the opened position.

FIG. 4 illustrates a view of the narrow side of the installation switching device 1 when the connecting clamp is in the opened position. The conductor insertion opening 44 is open. The skirt is displaced downwards into the inner housing region below the conductor insertion opening 44, cf. also FIG. 3 for comparison. The U-shaped protruding portion 45 that protrudes on the outside of the housing narrow side prevents contact being made through the open conductor insertion opening 44 with potentially live parts of the clamping frame 12.

Figure 6:
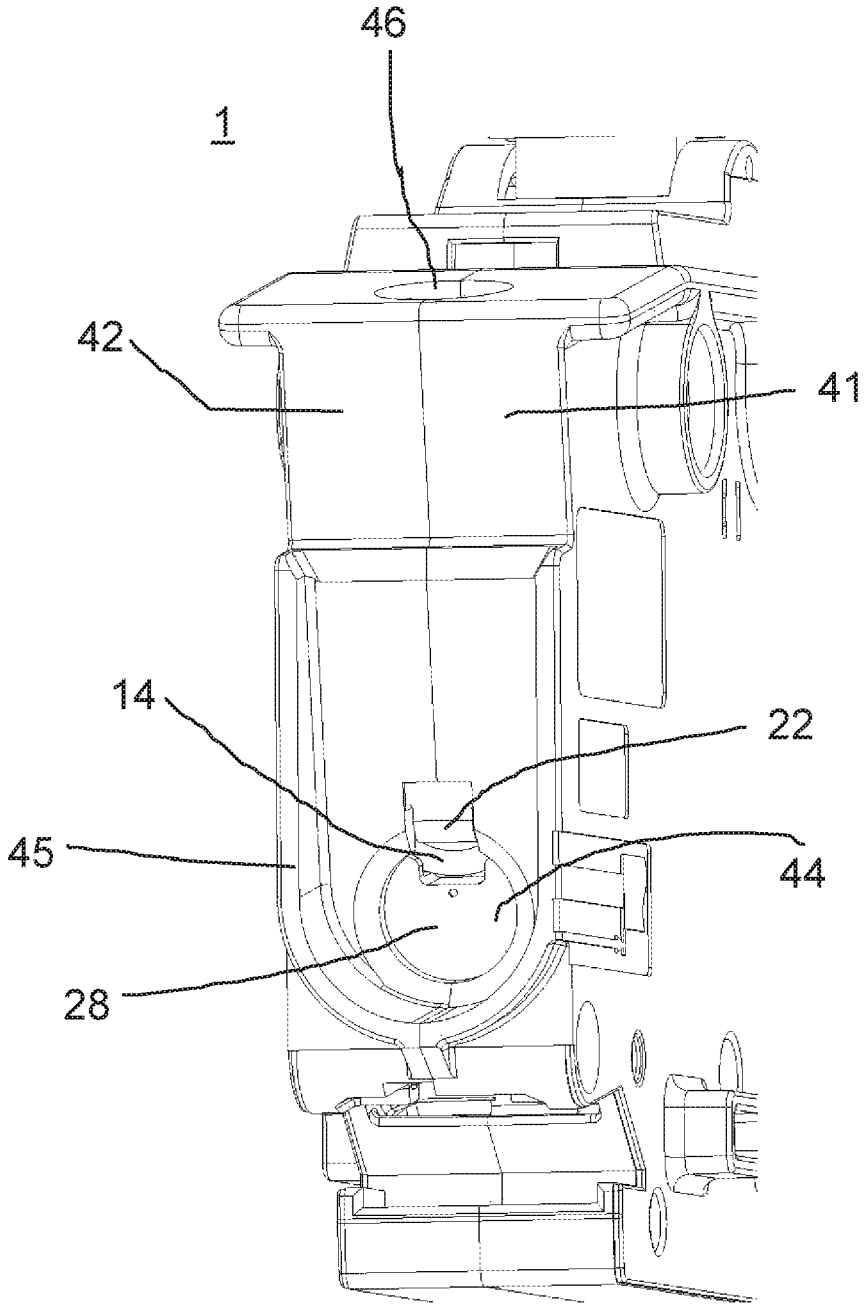
FIG. 6 illustrates a view of the narrow side of an installation switching device in accordance with one embodiment of the invention when the connecting clamp is in the closed position.

FIG. 6 illustrates a view of the narrow side of the installation switching device 1 when the connecting clamp is in the closed position. The conductor insertion opening 44 is covered to a great extent by means of the skirt 28 that has been moved upwards. Protection against an incorrect insertion procedure is achieved by virtue of the fact that below the second narrow end side 14 of the clamping frame 12 there is no free opening into which it would be possible for a connecting conductor to be inserted incorrectly.

Figure 7:
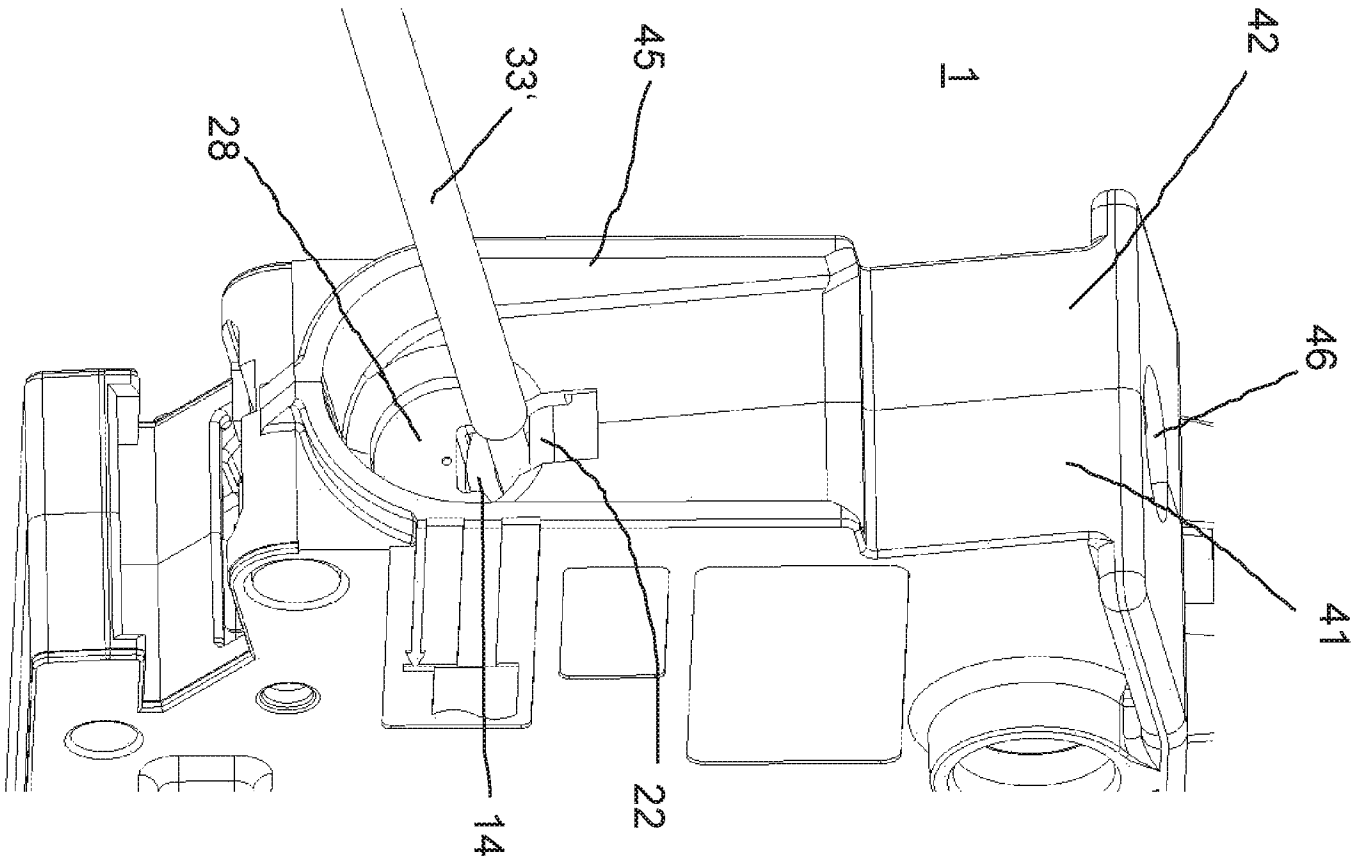
FIG. 7 illustrates a view of the narrow side of an installation switching device in accordance with an embodiment of the invention with an inserted connecting conductor that has a small conductor cross section.

FIG. 7 illustrates a view of the narrow side of the installation switching device 1 with an inserted connecting conductor 33' that has a small conductor cross section. The connecting conductor 33' is clamped between the contact rail 22 and the second narrow end side 14 of the clamping frame. The region below the second narrow end side 14 is covered by means of the skirt 28. An incorrect insertion of a further connecting conductor in this region is thereby likewise prevented as is contact with the potentially live second narrow end side 14 from the outside by means of a human finger.

Figure 8:
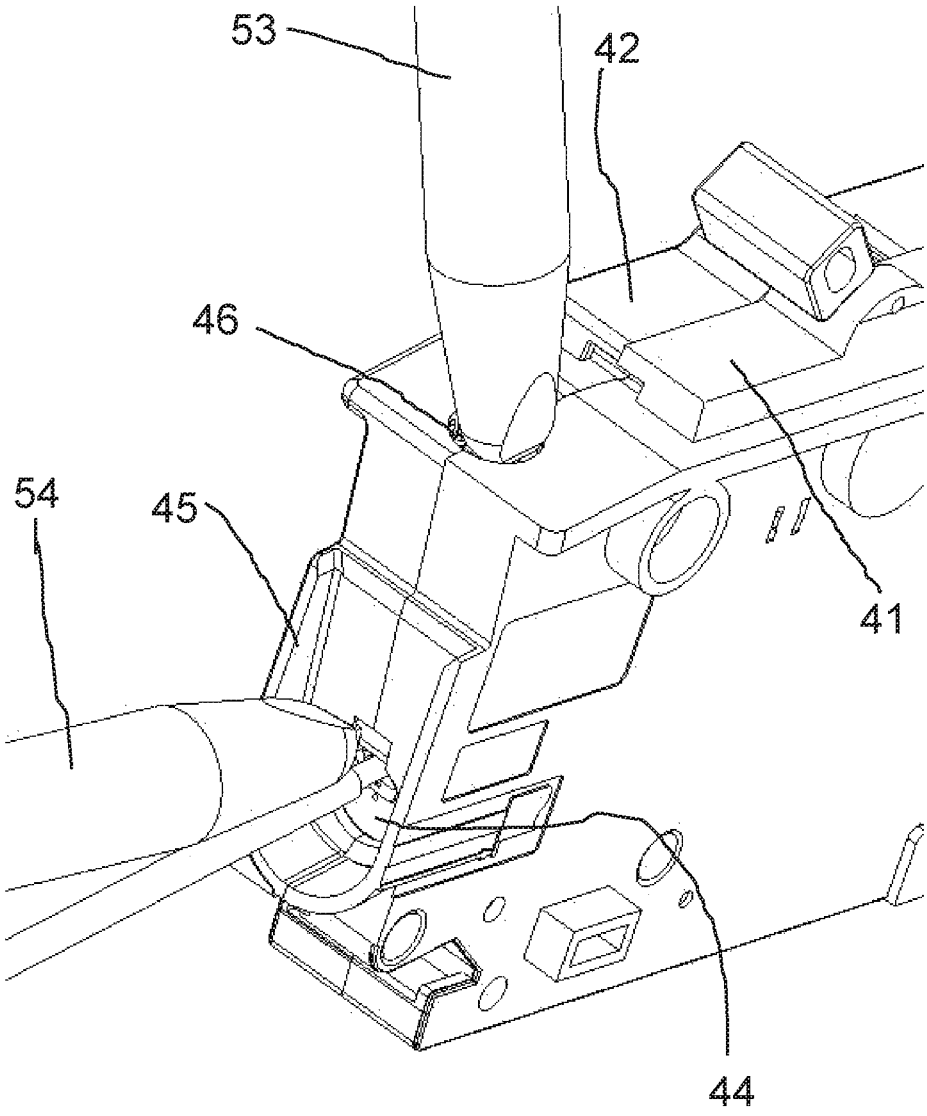
FIG. 8 illustrates a perspective view of an installation switching device in accordance with one embodiment of the invention with a first testing finger on the clamping screw access opening and a second testing finger on the clamp insertion opening with an inserted connecting conductor that has a small conductor cross section.

FIG. 8 illustrates a perspective view of the installation switching device 1 with a first testing finger 53 on the clamping screw access opening 46 and a second testing finger 54 on the clamping screw insertion opening 44 with an inserted connecting conductor 33' that has a small conductor cross section. FIG. 8 demonstrates the two-stage contact protection that is provided by means of the embodiment of the installation switching device in accordance with the invention, on the one hand on the clamping access opening 46 and on the other hand on the conductor insertion opening 44.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 Installation switching device
10 Contact clamp
12 Clamping frame
13 First narrow end side
14 Second narrow end side
15 First longitudinal side
16 Second longitudinal side
17 Clamp covering part

18 Clamping screw
19 Screw head
20 Screw shaft
21 Clamping end
22 Contact rail
23 First short arm
24 Second short arm
25 Connecting piece
26 Latching arm
26' Latching arm
27 Latching lug, first latching element
27' Latching lug, second latching element
28 Skirt
29 Overlapping strip end
30 Overlapping strip end
31 Latching opening
32 Free arm
32' Free arm
33 Connecting conductor
33' Connecting conductor that has a small cross section
40 Housing
41 First housing half shell
42 Second housing half shell
43 Housing side latching lug, second latching element
43' Housing side latching lug, second latching element
44 Conductor insertion opening
45 Protruding portion
46 Access opening
47 Narrow side
48 Joining line
49 Slot
50 Longitudinal slot
51 Guiding projection
52 Recess
53 First testing finger
54 Second testing finger

The invention claimed is:

1. An installation switching device comprising:

a housing; and at least one contact clamp, which is arranged in the housing, configured to connect at least one electrical conductor through a conductor insertion opening that is provided in the housing, the contact clamp comprising a clamping frame that has a rectangular cross section and a clamping screw that is configured to engage in a first narrow end side of the clamping frame and a clamping end of the clamping screw being configured to cooperate with a section of a contact rail that is fixedly mounted in the housing of the installation switching device, the section being located within the clamping frame, so that a second narrow end side that lies opposite the first narrow end side and is connected thereto via two longitudinal sides that lie opposite one another is configured to press an inserted connecting conductor against a surface of the contact rail that is remote from the clamping screw, wherein a clamp covering part is coupled to the clamping frame, wherein the clamp covering part has a tub-shaped cross section having two short arms that lie opposite one another and a connecting piece that connects the two short arms to one another, wherein a first short arm is coupled to the first narrow end side and a second short arm that lies opposite the first short arm is coupled to the second narrow side, and wherein the second short arm supports a skirt that protrudes over the second narrow end side in a direction facing away from the clamping screw.

2. The installation switching device according to claim 1, wherein the tub-shaped cross-sectional contour of the clamp covering part is configured to be adjusted to a frame-type outer contour of the clamping frame so that the clamp covering part is configured to be slid on in a sliding-on direction perpendicular to a broad side of a housing half shell after assembling the clamping frame in a first housing half shell of the housing.

3. The installation switching device according to claim 1, wherein the clamp covering part supports two latching arms that lie opposite one another and protrude out from the skirt laterally and in a resilient manner in a region of the skirt and are configured to be latched in a releasable manner to an inner face of the housing when the contact clamp is in the assembled position.

4. The installation switching device according to claim 3, wherein first latching elements are formed on the latching arms and second latching elements are formed on the inner face of the housing so as to cooperate in a latching manner when the connecting clamp is in an opened position.

5. The installation switching device according to claim 1, wherein the clamping frame comprises bent strip material, wherein the first end side comprises overlapping strip ends in which the clamping screw is configured to engage.

6. The installation switching device according to claim 1, wherein the first short arm comprises a latching opening so that the first short arm is configured to be latched to the latching opening on the clamping screw.

7. The installation switching device according to claim 6, wherein the latching opening is open on the narrow side of the first short arm that is remote from the connecting piece so that two free arms are formed at that location, as a result of which the first short arm is configured to slide onto the first end side whilst encompassing the clamping screw between the two free arms when the clamping frame has already been assembled in the housing.

8. The installation switching device according to claim 1, wherein the housing supports at least one protruding portion that protrudes outwards from a housing wall in a region of the insertion opening.

9. The installation switching device according to claim 8, wherein the protruding portion surrounds the insertion opening in a U-shaped manner.

10. The installation switching device according to claim 1, wherein the housing further comprises an access opening configured to provide access for an actuating tool to the clamping screw, the access opening being dimensioned so small in its free diameter that it is not possible for a human finger to touch the clamping screw through the access opening.

* * * * *